US010674888B2

(12) United States Patent
Kutto et al.

(10) Patent No.: US 10,674,888 B2
(45) Date of Patent: Jun. 9, 2020

(54) SYSTEM AND METHOD FOR VENTILATING A DISHWASHER

(71) Applicant: Whirlpool Corporation, Benton Harbor, MI (US)

(72) Inventors: Kevin T. Kutto, Maharashtra (IN); Kelly J. Smith, Benton Harbor, MI (US); Anthony B. Welsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 158 days.

(21) Appl. No.: 15/868,068

(22) Filed: Jan. 11, 2018

(65) Prior Publication Data

US 2018/0132696 A1 May 17, 2018

Related U.S. Application Data

(62) Division of application No. 15/224,841, filed on Aug. 1, 2016, now abandoned.

(51) Int. Cl.

| | |
|---|---|
| ***A47L 15/48*** | (2006.01) |
| ***A47L 15/42*** | (2006.01) |
| ***A47L 15/14*** | (2006.01) |
| ***A47L 15/00*** | (2006.01) |

(52) U.S. Cl.

CPC ..... *A47L 15/488* (2013.01); *A47L 15/0052* (2013.01); *A47L 15/14* (2013.01); *A47L 15/4261* (2013.01); *A47L 15/4263* (2013.01); *A47L 15/486* (2013.01)

(58) Field of Classification Search

CPC ..... A47L 15/488; A47L 15/4263

See application file for complete search history.

(56) References Cited

U.S. PATENT DOCUMENTS

| | | | |
|---|---|---|---|
| 3,443,719 A | 5/1969 | Duncan | |
| 2009/0288690 A1 | 11/2009 | Haeberle | |

FOREIGN PATENT DOCUMENTS

| | | | | |
|---|---|---|---|---|
| DE | 1428351 A1 | | 11/1968 | |
| EP | 1281345 A1 | | 2/2003 | |
| EP | 2400877 B1 | | 2/2010 | |
| GB | 2215991 A | * | 10/1989 | ..... A47L 15/4263 |
| GB | 2215991 B | | 8/1991 | |

* cited by examiner

*Primary Examiner* — Spencer E Bell
(74) *Attorney, Agent, or Firm* — McGarry Bair PC

(57) ABSTRACT

A dishwasher for treating dishes according to an automatic cycle of operation can comprise a tub defining a treating chamber with an access opening. A door can be selectively moveable to a closed position to close the access opening and can have a metal inner panel with a rear face confronting the treating chamber when the door is in the closed position. The door can have a lower edge overlying a portion of the tub when the door is in the closed position. A ventilating strip can be provided along the lower edge and can have vent openings passing through the strip. A seal can extend between the tub and the ventilating strip when the door is closed to form a liquid seal between the ventilating strip and the tub.

8 Claims, 8 Drawing Sheets

SYSTEM AND METHOD FOR VENTILATING A DISHWASHER

CROSS-REFERENCE TO RELATED APPLICATIONS

This application is a divisional application of U.S. patent application Ser. No. 15/224,841, filed Aug. 1, 2016, which is incorporated herein by reference in its entirety.

BACKGROUND OF THE INVENTION

Dishwashers typically have a configuration of an open-faced tub that is closed by a door hingedly mounted to the dishwasher at a lower end of the door. This configuration creates an air gap between the lower end of the door and an inner surface of the tub. A seal is typically provided to close the gap and prevent the escape of liquids during operation. However, while the seal is often not a perfect seal, it performs well enough that residual moisture in the tub can create odors, which can build up inside the tub when the door is closed and the dishwasher is not operating. One solution to the odor issue is to either install venting slots on an inner panel of the door, or to mold venting ducts along the lower edge of a plastic door panel, where an interior of the door couples the vents to the ambient environment. Unfortunately, venting slots facing the spray of water may take water into the interior of the door, which is not desirable. It is also relatively costly to form venting ducts along the lower edge in the case of a metal inner door panel. Further, vents along the lower edge may not cooperate well with the seal resulting in the seal folding over to block the vents when the door is closed.

Conventional dishwashers can use a separate side seal to overlap the lower edge seal of the door in order to form a liquid seal between the door and an access opening of the dishwasher. However, an imperfect overlap can result in a gap between the side and lower seals such that treating liquid leaks onto the kitchen floor at the bottom corners of the access opening. Further, noise generated by the dishwasher during the circulation or spraying of treating liquid can conduct to the ambient environment through any vents and thereby annoy people within the ambient environment.

SUMMARY OF THE INVENTION

In one embodiment, there is disclosed a dishwasher for treating dishes according to an automatic cycle of operation and which can comprise a tub defining a treating chamber with an access opening. A door can be selectively moveable to a closed position to close the access opening and can have a metal inner panel with a rear face confronting the treating chamber when the door is in the closed position. The door can have a lower edge overlying a portion of the tub when the door is in the closed position. A ventilating strip can be provided along the lower edge and can have vent openings passing through the strip. A seal can extend between the tub and the ventilating strip when the door is closed to form a liquid seal between the ventilating strip and the tub.

In another aspect, there is disclosed a dishwasher for treating dishes according to an automatic cycle of operation and can comprise a tub at least partially defining a treating chamber with an access opening. A sprayer can emit a liquid spray into the treating chamber. A door assembly can selectively close the access opening and can have an inner panel terminating in a lower edge. A ventilating strip with a plurality of vent openings can be mounted to the lower edge.

The inner panel and the ventilating strip can be arranged such and the vent openings can be sized such that at least some of the liquid sprayed into the treating chamber and running down the inner panel forms a surface tension membrane covering the vent openings.

In yet another embodiment, there is disclosed a method for attenuating noise generated during a spraying of liquid within a treating chamber of a dishwasher. The method can comprise forming a surface tension membrane over vent openings for the treating chamber from the liquid sprayed within the treating chamber.

DETAILED DESCRIPTION

As may be appreciated, based on the disclosure, there exists a need in the art for a solution to ventilating a dishwasher while sealing the door to a tub of the dishwasher. Also, there exists a need in the art for venting a lower edge of a metal door panel on a dishwasher while sealing the door to a tub of the dishwasher. Additionally, there exists a need in the art for an improved method of sealing the door at bottom corners of an access opening to the dishwasher. Further, there exists a need in the art for reducing noise transmitted to an ambient environment from the interior of the dishwasher.

Figure 1:
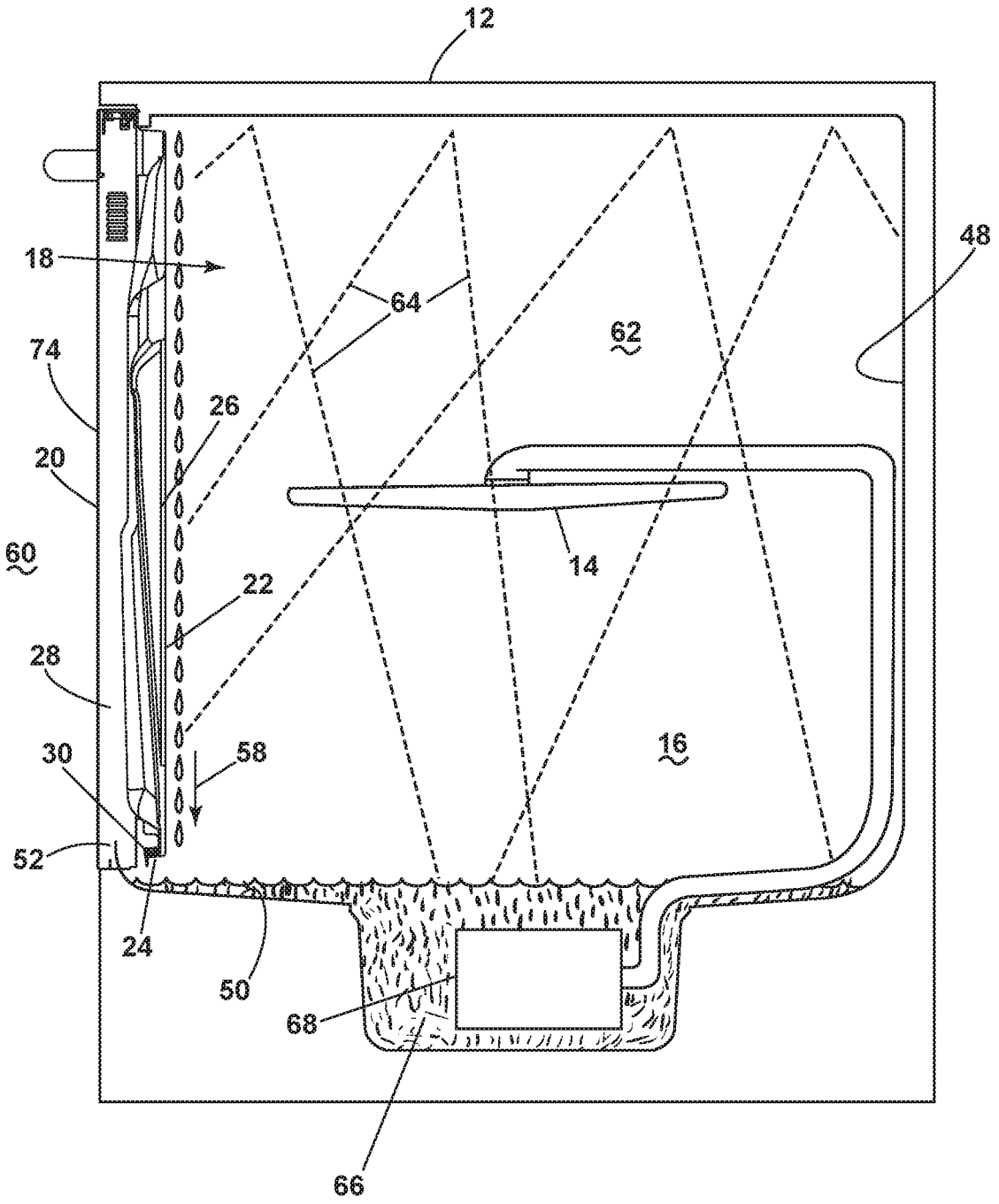
FIG. 1 illustrates a side cross section of a dishwasher with a ventilated door, in accordance with a first embodiment of the present disclosure.

In a first embodiment of the present disclosure, FIG. 1 illustrates a dishwasher 12 that can comprise a tub 50 at least partially defining a treating chamber 16 with an access opening 18 for receiving dishes (not shown) to be treated according to a cycle of operation. As used in this description, the term "dish(es)" is intended to be generic to any item, single or plural, that can be treated in dishwasher 12, including, without limitation: dishes, plates, pots, bowls, pans, glassware, silverware, and other utensils. The dishwasher 12 can include a door assembly 20 selectively moveable to a closed position to close the access opening 18. Door 20 can include an outer panel 74 and a metal inner panel 22 and can have an interior 28 between them. Inner panel 22 can include a rear face 26 confronting the treating chamber 16 when door 20 is in the closed position. Door 20 can also include a lower edge 24 overlying a portion of tub 50 when door 20 is in the closed position. A sprayer 14 can emit a spray of liquid 64 being circulated by circulation pump 68 within treating chamber 16 during the cycle of operation. Noise 62 can be generated during a liquid spray 64 within treating chamber 16, some portion of which can reach ambient environment 60. For example, circulation pump 68 can generate noise 62 heard in ambient air 60.

Treating chamber 16 can further include side walls 48. Liquid spray 64 emitting from sprayer 14 can impinge the side walls 48 and rear face 26 and run down into tub 50 to collect as a pooled liquid 66. Tub 50 can include a tub lip 52 that can protrude up into the interior 28 of door 20 when the door 20 is closed, where the tub lip 52 can retain the pooled liquid 66. In particular, liquid spray 64 can form a fluid path 58 running down rear face 26 and collecting in tub 50. When there is no liquid spray 64, the ventilating strip 30 can fluidly couple treating chamber 16 to ambient air 60, or can fluidly couple the treating chamber 16 to ambient air 60 through the interior 28 of door 20.

Additional features of a conventional automatic dishwasher can be present in dishwasher 12 but will not be described in detail herein except as necessary for a complete understanding of the invention. The present invention is described in terms of a conventional dishwashing unit, and could also be implemented in other types of dishwashing units, such as in-sink dishwashers, multi-tub dishwashers, or drawer-type dishwashers.

Figure 2A:
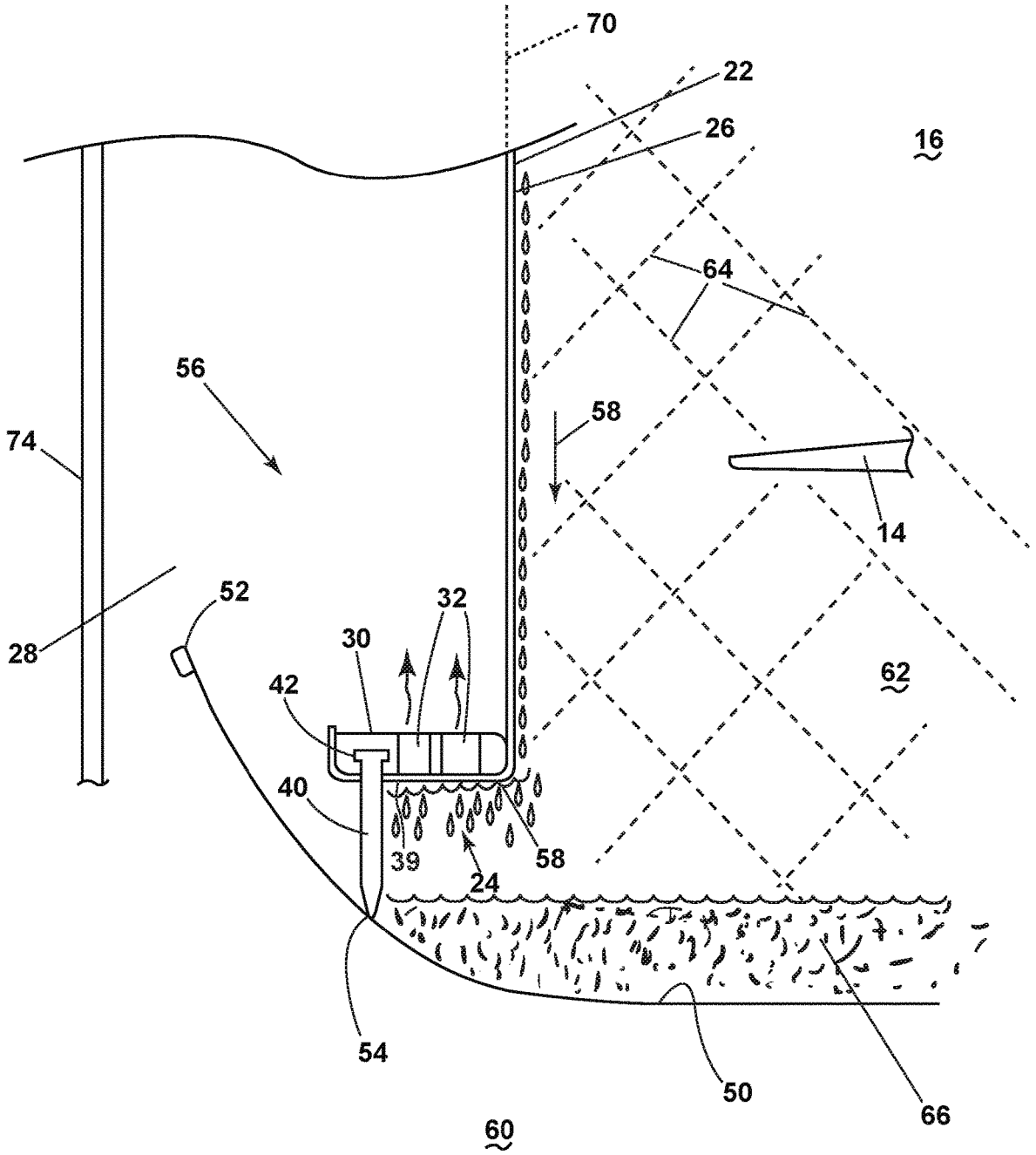
FIG. 2A illustrates an enlarged side sectional view of a lower edge of a ventilated door of FIG. 1 in a closed position receiving a flow of liquid.

Referring now to FIG. 2A, a ventilating strip 30 along with a seal 40 can be provided along lower edge 24 of the door 20. The ventilating strip 30 can include vent openings 32 passing through the strip 30 and a bottom face 39 facing the tub. Vent openings 32 can fluidly couple the treating chamber 16 to an interior 28 of the door 20 and/or the surrounding ambient air 60. The seal 40 extends between tub 50 and ventilating strip 30 to form a liquid seal 54 between ventilating strip 30 and tub 50 when door 20 is closed. Strip 30 and seal 40 can be juxtaposed such that vent openings 32 are fluidly coupled to treating chamber 16 when the liquid seal 54 is formed. To effect the juxtaposition, a strip channel 42 can be formed in the ventilating strip 30 downstream of the vent openings 32 in terms of the fluid path 58 flowing out of treating chamber 16, and the seal 40 can be mounted to the strip channel 42. The seal 40 can be press-fit within the strip channel 42 or secured in other ways, such as by adhesive or fasteners. Alternatively, the seal 40 can be clamped (not shown) between strip 30 and lower edge 24, or seal 40 and strip 30 can be over-molded as one flexible component which can then be fastened or adhered to lower edge 24.

The lower edge 24 of the door 20 can be positioned below tub lip 52 such that any liquid splashed into vent openings 32 does not flow into ambient environment 60. Lower edge 24 can also be positioned above pooled liquid 66 for preventing food particles from lodging in vent openings 32. The ventilating strip 30 can be arranged relative to the inner panel 22 to cause a continuous attached flow of liquid spray 64 along fluid path 58 across the bottom face 39 of the ventilating strip 30. For example, the ventilating strip 30 can be shaped to form a convex corner with the inner panel 22 that adheres a liquid flow across vent openings 32 according to the Coanda Effect.

The seal 40 can be made of rubber or any resilient or compressible material suitable for forming liquid seal 54. Ventilating strip 30 can be made of a rigid plastic, and can be fastened to lower edge 24 using fasteners, clips, snaps, adhesive, or by any other means known in the art. Alternatively, the ventilating strip 30 can be made of metal, or can be distributed across lower edge 24 in sections such that only portions of lower edge 24 are provided with vent openings 32. Beneficially, mounting the seal 40 to strip 30 can provide a two-piece solution to ventilating and sealing treating chamber 16. In particular, the two-piece solution can reduce the cost of ventilating and sealing a door with a metal inner panel 22 by avoiding a complex shaping of the metal inner panel. By juxtaposing the seal 40 downstream of and in fixed contact with strip 30, the seal 40 can be prevented from folding over to block vent openings 32 when the door 20 is closed. Door assembly 20 can also include a fan (not shown) for circulating air between ambient 60 and chamber 16 through vent openings 32 whenever ventilation is desired.

Figure 2B:
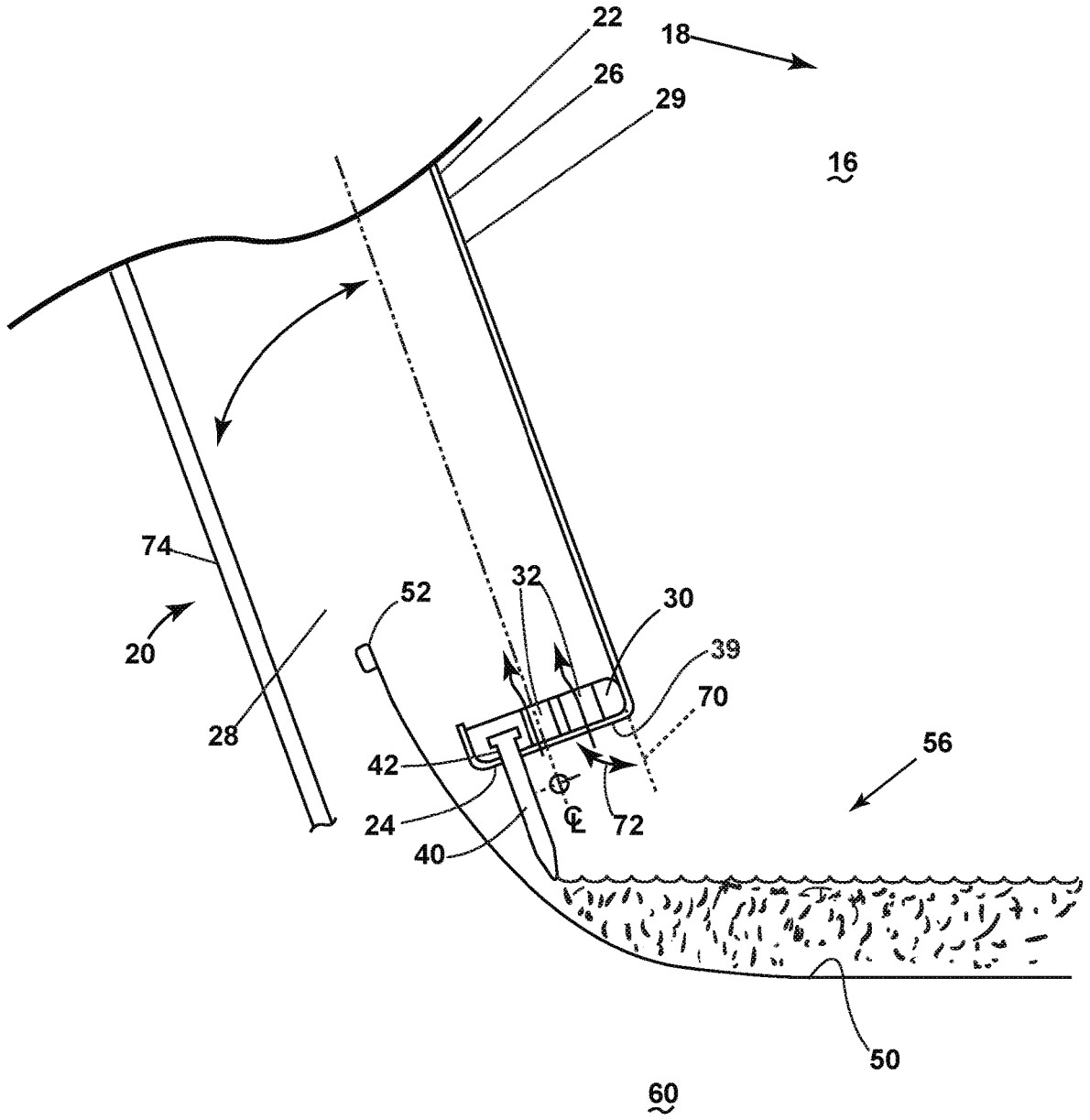
FIG. 2B illustrates a side sectional view of the ventilated door of FIG. 2A in a partially open position.

Referring now to FIG. 2B, the door 20 of FIG. 2A is shown in an open position and without the spraying liquid. The inner panel 22 can define a panel plane 70 and ventilating strip 30 can form an interior angle 72 of ninety degrees with respect to panel plane 70 so that bottom face 39 of the strip 30 faces the tub 50 for avoiding a direct liquid spray 64. Door 20 can hingedly mount near a bottom 56 of access opening 18 and can pivot about a centerline (CL) so that the seal 40 breaks contact with tub 50.

Figure 3A:
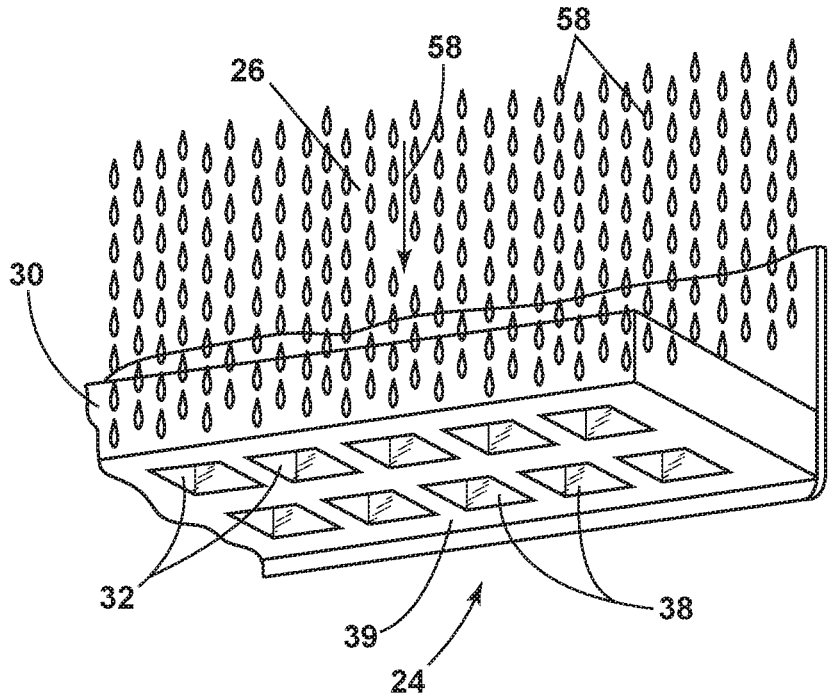
FIG. 3A illustrates a sectional perspective view of a first configuration of vent openings for the first embodiment.

Referring to FIG. 3A vent openings 32 can be arranged in two rows and be of a square geometry. Openings 32 can also have any geometry fluidly coupling to treating chamber 16, such as a rectangular, circular, or an oval-shaped opening. A series of vent openings in a row can be punctuated by regions of strip 30 not having vent openings (not shown here), such as for fasteners fastening strip 30 to lower edge. The vent openings 32 can be sized and shaped such that the continuous attached fluid flow of fluid path 58 across the bottom face 39 of the ventilating strip 30 forms a surface tension membrane 38 over vent openings 32. That is, the vent openings are of a size that the surface tension of the liquid is sufficient for some of the liquid to be retained within each of the openings as it flows over the vent openings. One or more of the vent openings with retained liquid form the surface tension membrane. The surface tension membrane 38 can attenuate noise 62 generated within treating chamber 16 and passing through the vent opening 32 to ambient 60. The noise 62 may arise from the liquid spraying and/or from any noise-generating processes within treating chamber 16.

Figure 3B:
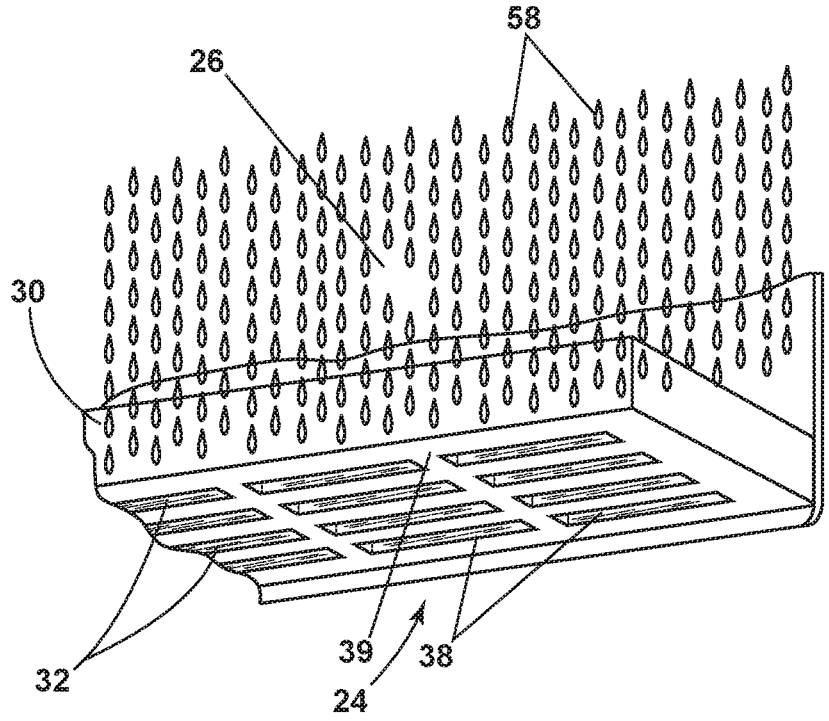
FIG. 3B illustrates a sectional perspective view of a second configuration of vent openings with a surface tension membrane.

Referring to FIG. 3B, strip 30 can comprise an alternate configuration of vent openings 32 having four rows where each vent opening can be a rectangular slit. The dimensions of a rectangular slit can be chosen to form and retain surface tension membrane 38 arising from fluid path 58 and can be sized to better attenuate noise 62 from reaching ambient 60. Vent openings 32 can be configured so that surface tension membrane 38 forms during a spray of liquid and releases during a drying cycle for venting moisture-laden air accumulated during the washing cycle. The surface tension membrane 38 provides a convenient way to block the vent openings during a washing cycle involving the liquid spray 64 without having to rely on mechanical closures for the vent openings 32. The vent openings 32 can also be sized, shaped, and/or oriented to avoid clogging by food particles and other materials circulating in treating chamber 16.

Tilting the ventilating strip 30 to an interior angle 72 (FIG. 2B) of less than 90 degrees can be undesirable by subjecting the vent openings to turbulence in fluid path 58 and/or from liquid spray 64 which disrupts the formation of membrane 38. However, adjusting the interior angle 72 to ninety degrees or greater can optimize the attachment of fluid path 58 to ventilating strip 30, can maximize the formation of membrane 38 for attenuating noise 62, and/or can minimize a clogging of the vent openings 32 by food particles circulating in the treating chamber 16. Vent openings 32 can be positioned above pooled liquid 66 (FIG. 2A) to sustain surface tension membrane 38 undisturbed by the pooled liquid and/or to prevent food particles from clogging vent openings 32.

Figure 4:
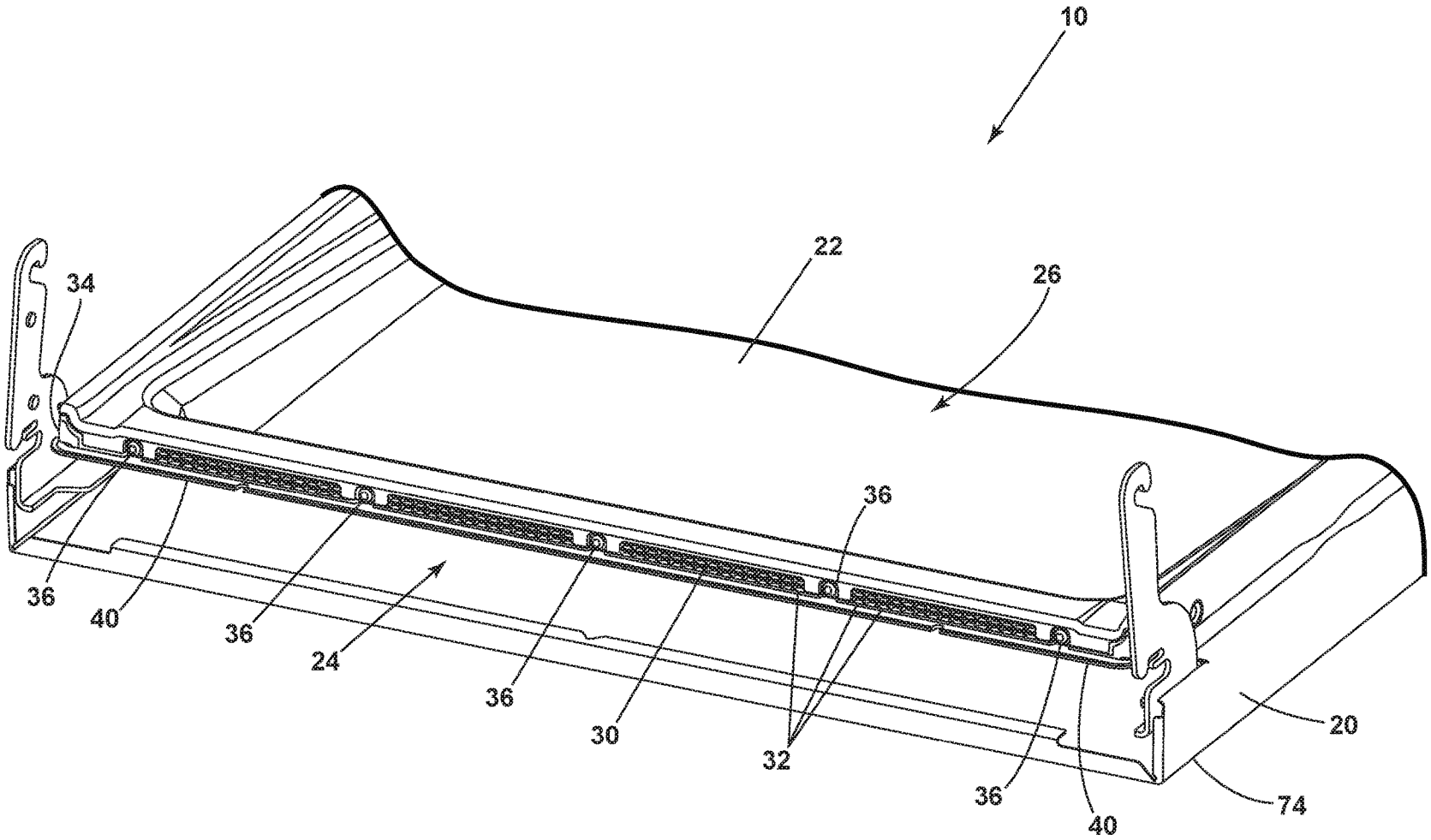
FIG. 4 illustrates a perspective view of a lower edge of the ventilated door of the first embodiment.

Referring now to FIG. 4, the ventilating strip 30 can be fastened to lower edge 24 of door 20 using strip fasteners 36. Portions of inner panel 22 can be formed into lower edge 24 to provide an attachment lip for receiving fasteners 36. The seal 40 can be mounted to strip 30 outside of vent openings 32 such that vent openings 32 are fluidly coupled to the treating chamber when the seal 40 forms the liquid seal. Seal 40 can be mounted to strip 30 using a strip channel in strip 30 or by clamping the seal 40 between ventilating strip 30 and lower edge 24. Inner panel 22 can have a complex shape, such as a middle portion that is concave for clearing dishes loaded into treating chamber 16 and/or for catching liquid collected on rear face 26 of the door 20.

Figure 5:
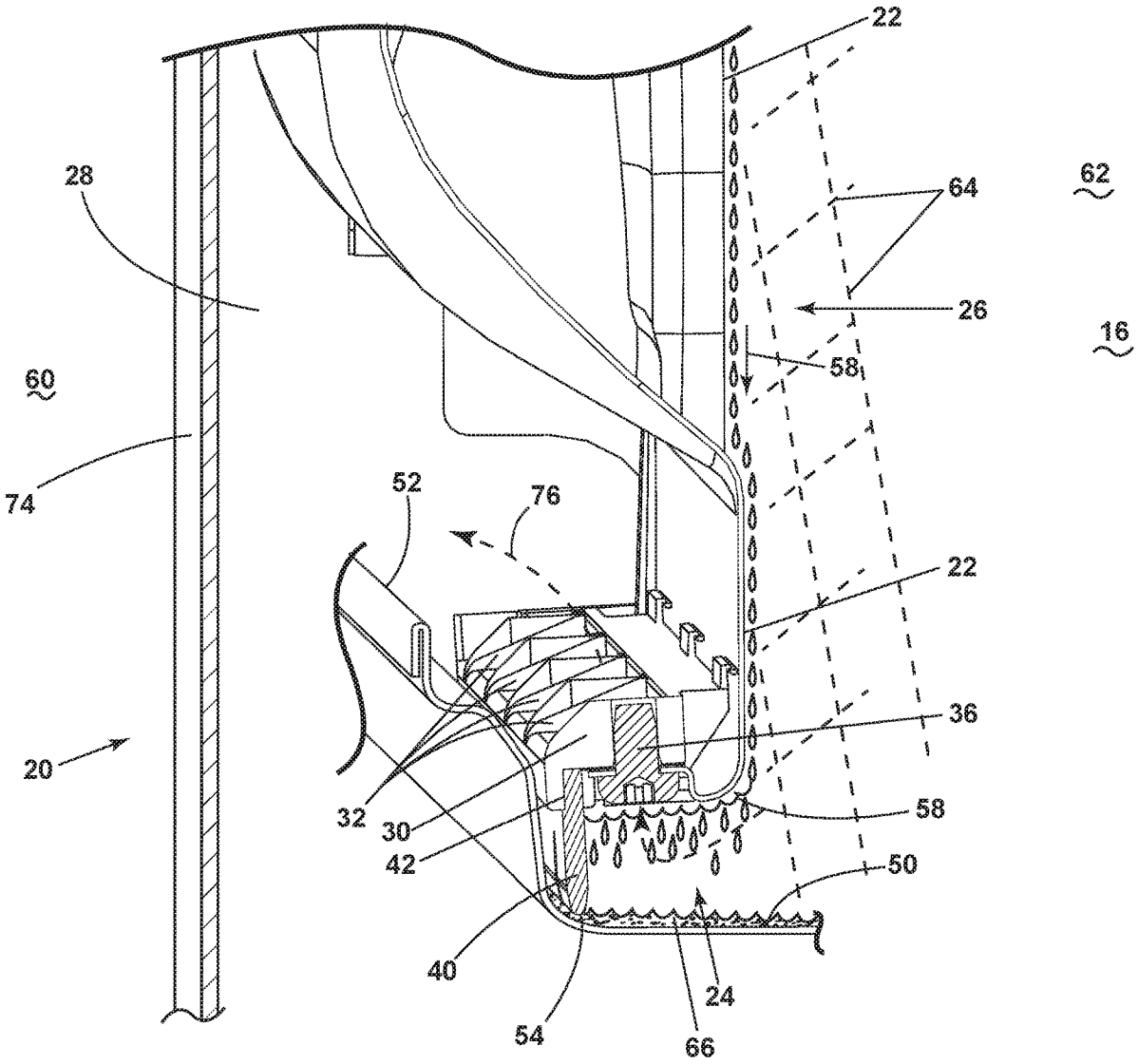
FIG. 5 illustrates a sectional perspective view of the ventilated door of FIG. 4 receiving a flow of liquid.

FIG. 5 illustrates a sectional perspective of the ventilated door of FIG. 4 in full detail that is receiving a liquid spray 64 and resulting fluid path 58. Inner panel 22 can have a complex yet generally planar shape and can form door interior 28 in cooperation with outer door panel 74. Liquid can flow along fluid path 58 down inner panel 22 during liquid spray 64 and can attach to ventilating strip 30 when strip 30 is properly arranged in relation to inner panel 22 for an attached flow of the liquid. In the absence of liquid spray 64 and fluid path 58, ventilation 76 can occur through vent openings 32 for removing moisture and/or odor from treating chamber 16.

Figure 6A:
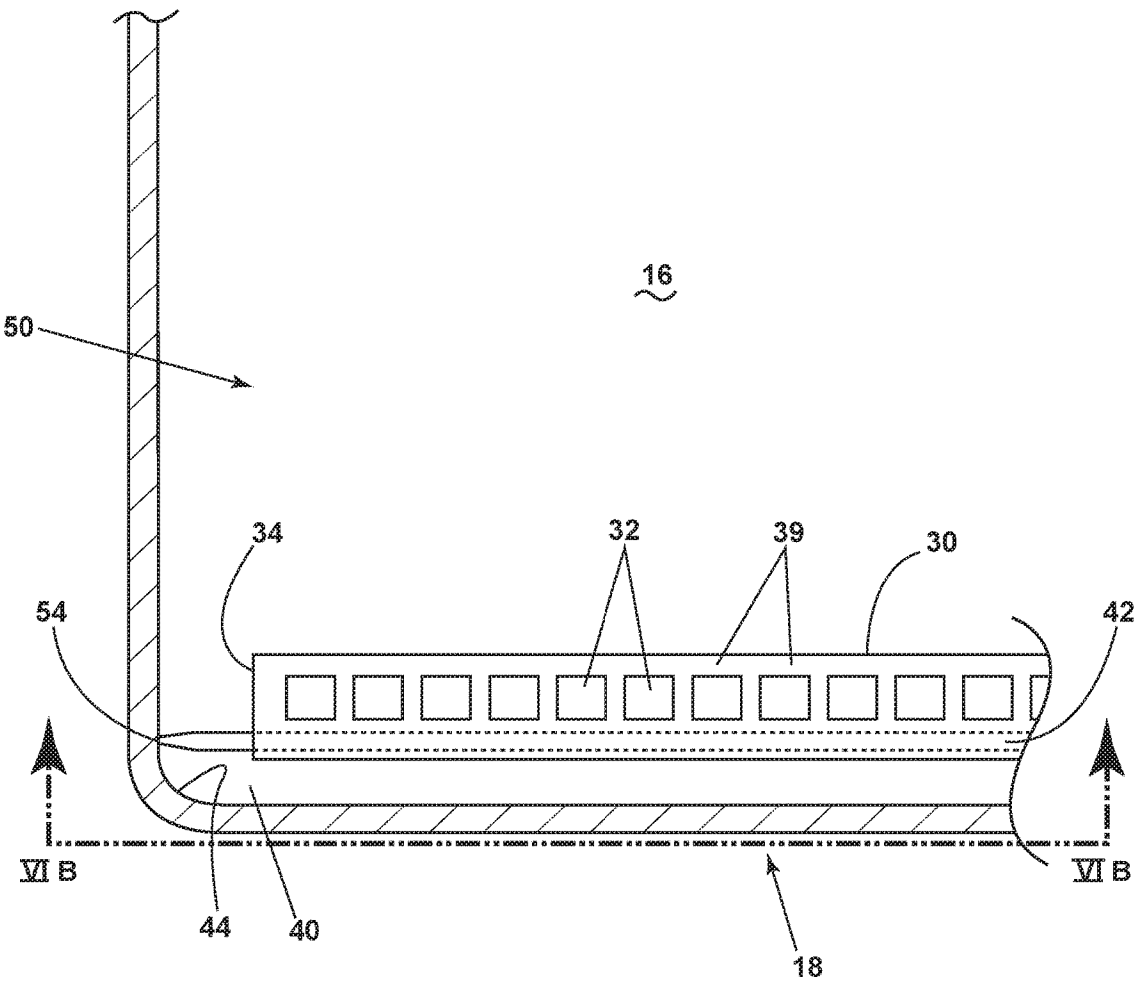
FIG. 6A illustrates a top sectional view of the seal of FIG. 4.

FIG. 6A illustrates a top view of a corner seal feature of FIG. 4. Tub 50 can include opposing corners 44 (one corner is shown) of tub 50 at access opening 18, and the ventilating strip 30 can have opposing ends 34 (one end is shown) corresponding each to one of the opposing corners 44. Seal 40 can extend between the ends 34 and the corners 44 when door 20 is closed to form a liquid seal 54 at the bottom corners as well as along the bottom 56 of the access opening 18. Strip 30 can secure seal 40 within a strip channel 42 and seal 40 can wrap around opposing ends 34 of the strip and extend the liquid seal 54 to opposing corners 44. Beneficially, this corner seal feature can eliminate the water leakage problem common to dishwashers. In an embodiment not shown, a side gasket of access opening 18 can be designed to meet seal 40 at a location higher than vent openings 32 for keeping water from spraying or surging out of treating chamber 16 through a gap between the side gasket and the seal 40.

Figure 6B:
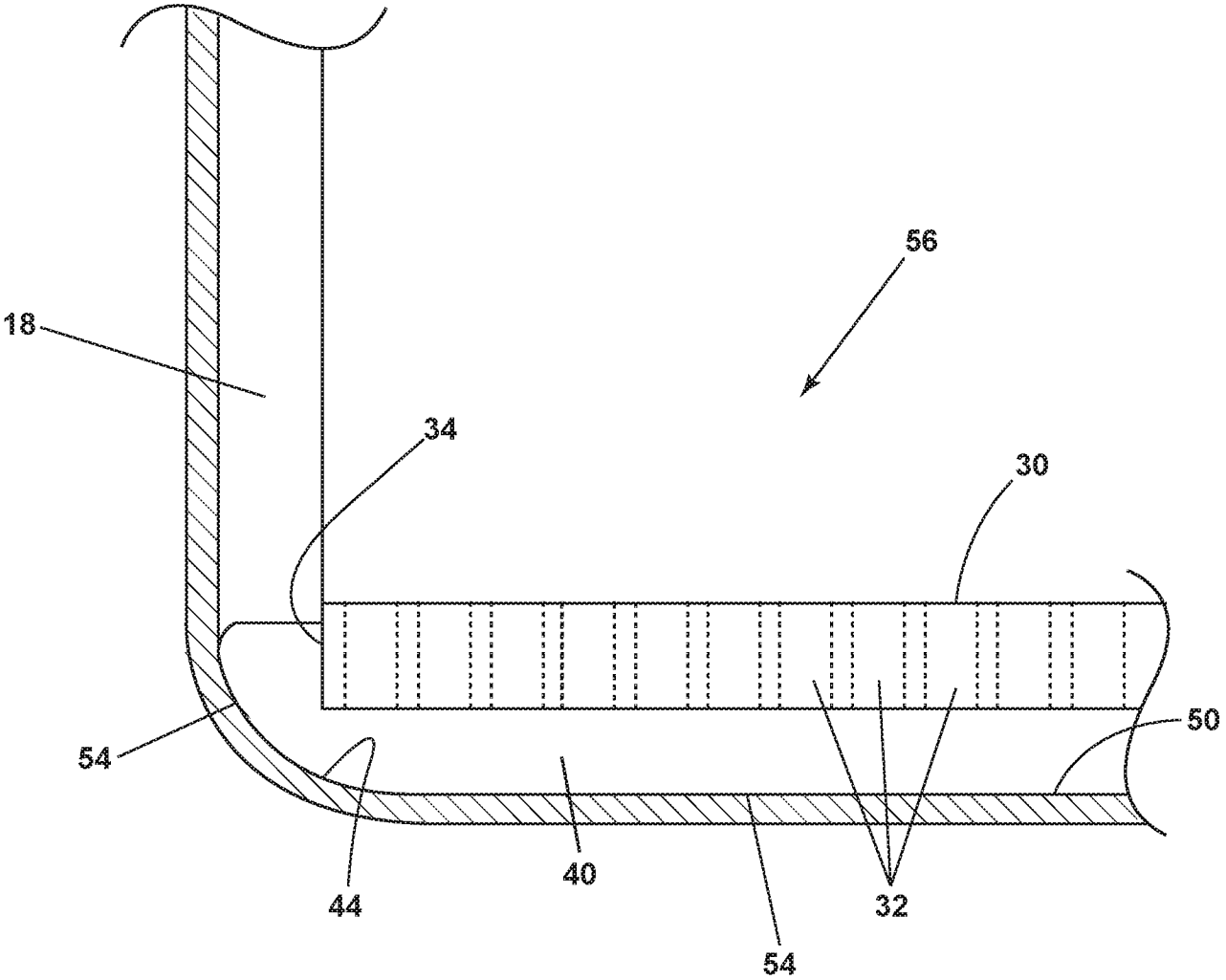
FIG. 6B illustrates a front sectional view of the seal of FIG. 6B.

Referring to FIG. 6B, in a front view of the corner seal feature of FIG. 6A, seal 40 can extend between the ventilating strip 30 and the bottom 56 of access opening 18 and can also extend around the corner to provide a liquid seal 54 between opposing ends 34 of strip 30 and opposing corners 44 of tub 50. Beneficially, a side gasket (not shown) can meet bottom seal 40 along a straight line and avoid the water leakage problems of conventional dishwashers.

In other embodiments, instead of mounting the seal 40 to strip 30, seal 40 can be mounted to tub 50 for sealing against ventilating strip 30 when door 20 is closed. Or, interleaving sections of seal 40 can be alternately attached to strip 30 and tub 50 along a length of lower edge 24, where the interleaved sections meet to form one continuous liquid seal 54 when the door is closed. The materials and dimensions of seal 40 can be chosen to form a liquid seal 54 that prevents liquid from spraying out of treating chamber 16 into door interior 28 or to ambient environment 60, and liquid seal 54 can be designed to prevent pooled liquid 66 from surging out of tub 50. However, liquid seal 54 is not necessarily watertight when submerged in liquid for a prolonged period and can permit seeping from tub 50. While the vent openings 32 are shown in the ventilating strip 30, they can, alternatively, be located within treating chamber 16 at other locations where the sprayed liquid can form a surface tension membrane over the vent openings 32. For example, vent openings can be located on the rear face 26 of door 20 or on side walls 48 of treating chamber 16.

While the present invention is described in terms of a conventional dishwashing unit, it could also be implemented in other types of dishwashing units, such as in-sink dishwashers, multi-tub dishwashers, or drawer-type dishwashers. The dishwasher 12 shares many features of a conventional automatic dishwasher, which will not be described in detail herein except as necessary for a complete understanding of the invention. The door can be hingedly mounted to the dishwasher 12 about a centerline (FIG. 5*b*) and can move between an opened position for loading dishes (not shown) into the treating chamber 16 and a closed position (FIG. 1).

Many other possible embodiments and configurations in addition to that shown in the above figures are contemplated by the present disclosure. To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Moreover, while "a set of" or "a plurality of" various elements have been described, it will be understood that "a set" or "a plurality" can include any number of the respective elements, including only one element. Combinations or permutations of features described herein are covered by this disclosure.

This written description uses examples to disclose embodiments of the disclosure, including the best mode, and also to enable any person skilled in the art to practice embodiments of the disclosure, including making and using any devices or systems and performing any incorporated methods. The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A dishwasher for treating dishes according to an automatic cycle of operation, the dishwasher comprising:

a tub defining a treating chamber with an access opening;

a door selectively moveable to a closed position to close the access opening and having a metal inner panel defining a panel plane with a rear face confronting the treating chamber when the door is in the closed position and a lower edge overlying a portion of the tub when the door is in the closed position;

a ventilating strip provided along the lower edge and having vent openings passing through the strip; and a seal extending parallel to the panel plane between the tub and the ventilating strip when the door is closed to form a liquid seal between the ventilating strip and the tub when the door is in the closed position;

wherein when the door is moved to an open position the seal breaks contact with the tub; and wherein the ventilating strip and seal are juxtaposed such that the vent openings are fluidly coupled to the treating chamber when the seal forms the liquid seal and the vent openings are located between the seal and the panel plane.

2. The dishwasher of claim 1 wherein the vent openings fluidly couple the treating chamber to ambient air.

3. The dishwasher of claim 2 wherein the vent openings fluidly couple the treating chamber to an interior of the door, with the interior fluidly coupled to the ambient air.

4. The dishwasher of claim 1, wherein the seal contacts the ventilating strip downstream of the vent openings in terms of a fluid path flowing out of the treating chamber.

5. The dishwasher of claim 1, wherein the tub defines opposing corners and the ventilating strip has opposing ends, with each end corresponding to one of the opposing corners, and the seal extends between the ends and the corners.

6. The dishwasher of claim 1, wherein the ventilating strip further comprises a strip channel and a portion of the seal is received within the strip channel to mount the seal to the ventilating strip.

7. The dishwasher of claim 1, wherein the tub further comprises a tub lip at a bottom of the access opening.

8. The dishwasher of claim 7, wherein the lower edge lies below the tub lip.

* * * * *